US005809575A

United States Patent [19]

Chen

[11] Patent Number: 5,809,575

[45] Date of Patent: Sep. 22, 1998

[54] SOCKS WITH A HIDDEN SHOEHORN

[76] Inventor: Yen-Shing Chen, 3Fl, 23, Alley 4, Lane 155, Pateh Rd., Sec 3, Taipei, Taiwan

[21] Appl. No.: 850,324

[22] Filed: May 2, 1997

[51] Int. Cl.[6] ..... A41B 11/00

[52] U.S. Cl. ..... 2/239; 2/409

[58] Field of Search ..... 2/239, 409, 241; 223/111, 113, 118

[56] References Cited

U.S. PATENT DOCUMENTS

| | | | |
|---|---|---|---|
| 2,649,588 | 8/1953 | Kantor | 2/239 |
| 3,224,123 | 12/1965 | Templeton | 2/239 |
| 3,315,276 | 4/1967 | Daxe | 2/239 |
| 3,601,818 | 8/1971 | Chesebro | 2/239 |

FOREIGN PATENT DOCUMENTS

| | | | |
|---|---|---|---|
| 2271923 | 4/1994 | United Kingdom | 2/239 |

*Primary Examiner*—Gloria M. Hale

*Attorney, Agent, or Firm*—Thomas I. Rozsa; Tony D. Chen

[57] ABSTRACT

A sock with a shoehorn which is generally an elongated elastic tube band. The tube band has a slippery inner wall which is not very thick. The tube band is attached closely to a bottom heel portion of the sock with its two opposite ends fixed on a symmetrical line on both sides of the sock. A wearer holds an open collar or rim of the shoe and inserts their foot into the shoe such that their foot pushes forward and down on the bottom heel portion of the sock, which in turn pushes the tube band against the collar of the sock, where the tube band is rolled against the collar to a location adjacent to a rear heel portion of the sock. The tube band which was under the bottom heel portion of the sock is rolled back to the rear heel portion of the sock and concealed inside the shoe.

12 Claims, 3 Drawing Sheets

FIG.1a
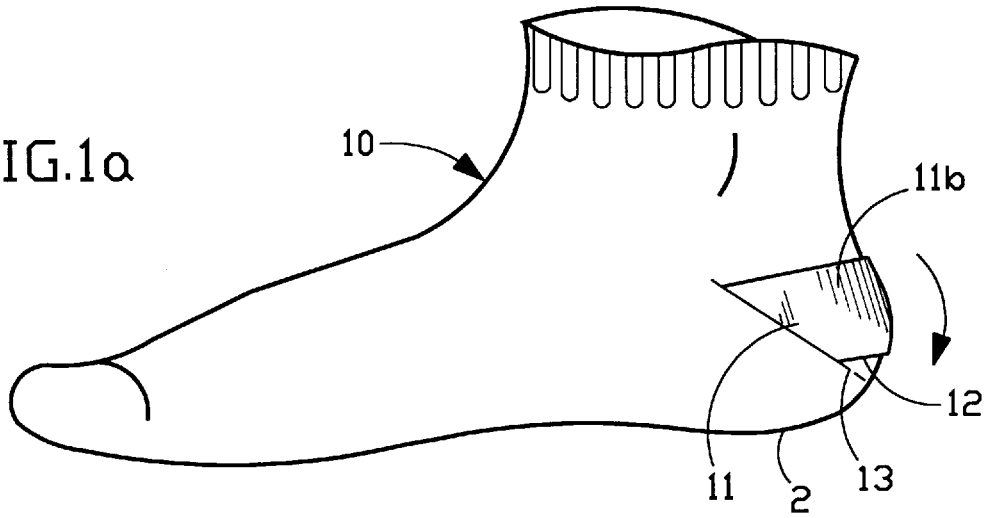
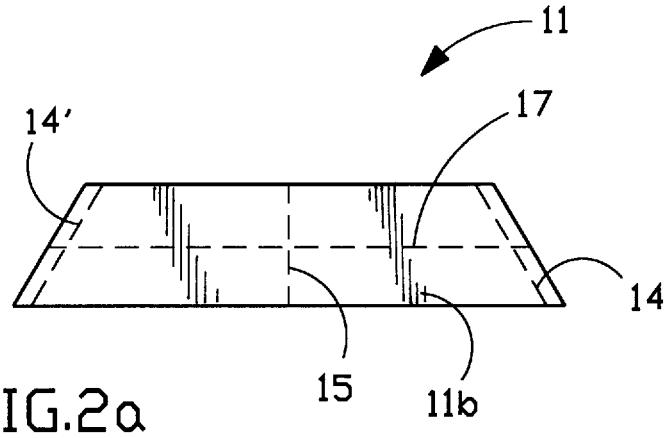
FIG.2a

SOCKS WITH A HIDDEN SHOEHORN

BACKGROUND of THE INVENTION

1. Field of the Invention

The present invention generally relates to the field of socks. More particularly, the present invention relates to the field of socks with a hidden shoehorn.

2. Description of the Prior Art

Generally, tying shoelaces is an everyday event and is a very annoying thing to do. Some people tie their shoelaces loosely to avoid wasting time. Tying shoelaces make people want to get rid of them. Several prior art devices have been developed for improving the wearing of shoes, especially from an athletic shoe standpoint, but from a sock standpoint, only few improvements have been made over the years.

It is desirable to provide a sock with a shoehorn capable of facilitating the wearing of a shoe. It is also desirable to provide a sock with a shoehorn which protects a rear heel portion of the sock from wear and tear.

SUMMARY OF THE INVENTION

The present invention is a sock with a shoehorn which is generally an elongated elastic tubular band. The tubular band has a slippery inner wall which is not very thick. The tubular band is attached closely to a bottom heel portion of the sock with its two opposite ends fixed on a symmetrical line on both sides of the sock. A wearer holds an open collar or rim of the shoe and inserts his or her foot into the shoe such that the foot pushes forward and down on the bottom heel portion of the sock, which in turn pushes the tubular band against the collar of the sock, where the tubular band is rolled against the collar to a location adjacent to a rear heel portion of the sock. The tubular band which was under the bottom heel portion of the sock is rolled back to the rear heel portion of the sock and concealed inside the shoe.

The concept of the present invention is to have a sock with a shoehorn that provides a convenient way of wearing a shoe, saves time, and make it much easier to wear a shoe. The present invention sock with a shoehorn can be used not only in athletic shoes with special designs, but also with all kinds of shoes.

The present invention has many advantageous features, including:(1) it eliminates the trouble of tying shoe-laces and make wearing shoes easier and faster; (2) the wearer feels that not only the socks are attached to the feet closely without any pressure, but the collar nicely bridges the wearer's feet; (3) it protects the wearer's heel from inflaming due to the rubbing between the sock and shoe; and (4) it reduces the rubbing of the sock's heel, the collar of the shoe, and the shoe lining, and thereby extends the life of the socks and shoes.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1*a* is a side elevational view of the preferred embodiment of the present invention sock with a shoehorn, wherein a tubular band is stitched to a sock, showing the tubular band at its rolled position;

FIG. 2*a* is a plan view of the tubular band;

DESCRIPTION OF THE PREFERRED EMBODIMENT

Figure 1:
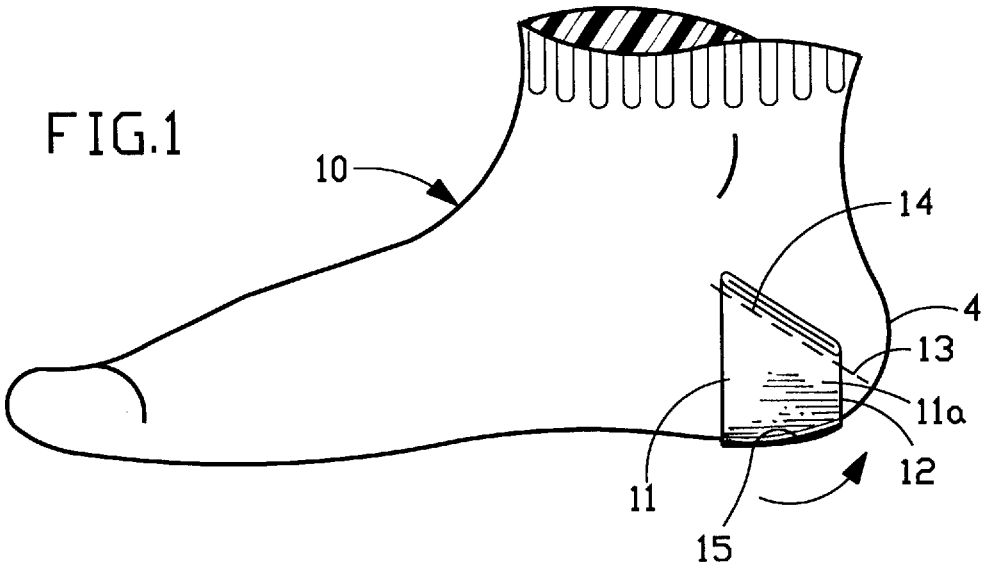
FIG. 1 is a side elevational view of the preferred embodiment of the present invention sock with a shoehorn, wherein a tubular band is stitched to a sock, showing the tubular band at its initial position.
Figure 2:
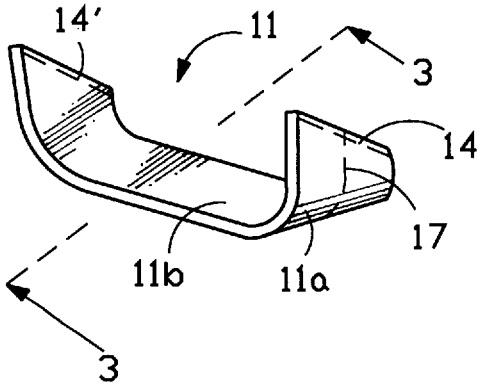
FIG. 2 is a perspective view of the tubular band.
Figure 3:
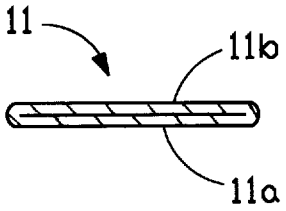
FIG. 3 is a cross-sectional view taken along line 3—3 of FIG. 2.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIGS. 1, 1*a*, 2, 2*a* and 3, there is depicted a preferred embodiment of the present invention sock 10 with a shoehorn 11 which is generally an elongated flat elastic tubular band fastened closely to an outer bottom heel portion 2 of the sock 10. The sock 10 also has an outer rear heel portion 4. The elastic tubular band 11 has two opposite ends which are symmetrically stitched on a heel seam 13 at both sides of the sock 10. The flat tubular band 11 has an inward face 11*b*, an outward face 11*a*, and a longitudinal center line 17. The tubular band 11 is made from a long strip of cloth, where a pair of opposite slip-stitched seams 14 and 14' lie on the center line 17 of the inward face 11*b* instead of the center line 17 of the outward face 11*a*. The reason for this is that when the tubular band 11 rolls from a bottom heel portion 2 to the rear heel portion 4 (see FIG. 1*a*), the slip-stitched seams 14 and 14' are concealed by the tubular band 11.

Referring FIGS. 1 and 1*a*, when wearing shoes, the sock's heel, the shoe's collar, and the lining of the shoes are interfacing with each other, such that the sock's heel is squeeze against the shoe's collar and the lining of the shoes. The inner wall of the tubular band 11 slides such that the outward face 11*a* turns over and abuts against the rear heel portion of the sock 10 (see FIG. 1*a*). To achieve the best results, before wearing a shoe, the wearer should pull the back side 12 of the tubular band 11 upwards to the original heel seam 13 of the sock 10 (see FIG. 1). The elastic tubular band 11 is positioned above the shoe's collar and when the sock 10 is inserted into the shoe, the tubular band 11 rolls upwardly from the bottom heel portion 2 to the rear heel portion 4 such that the elastic tubular band 11 facilities the wearing of the sock 10 and is hidden within the shoe (see FIG. 1*a*). Therefore, if a wearer removes his or her feet from the shoe, the tubular band 11 rolls downwardly back to its original position from the rear heel portion 4 to the bottom heel portion 2 (see FIG. 1).

Figure 4:
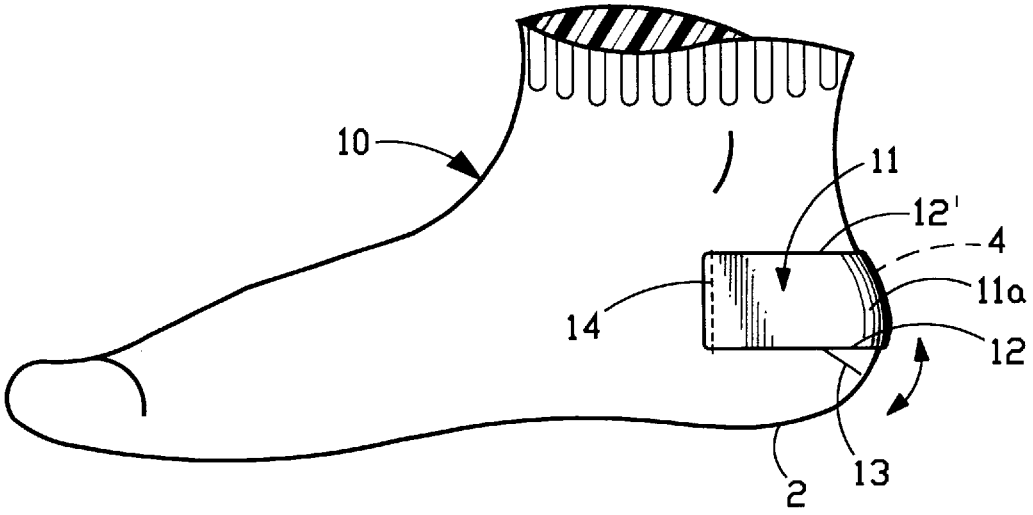
FIG. 4 is a side elevational view of an alternative location of the present invention sock with a shoehorn stitched to the sock, showing the tubular band at its initial position behind the rear heel portion of the sock.

Referring to FIG. 4, there is depicted at 10 an alternative location of the stitched seams of the present invention sock with a shoehorn which is stitched to the sock, where the tubular band 11 is positioned behind the rear heel portion 4 of the sock 10. In this design, the outward face 11*a* faces and abuts against the outer bottom heel portion 2 while the inward face 11*b* faces and abuts against the outer rear heel portion 4 of the sock 10 as shown. Prior to wearing the sock 10, the wearer turns over the upper side 12' of the tubular band 11 to the bottom heel portion 2 of the sock 10, which draws it closure to the original heel seam 13 of the sock 10.

Figure 5:
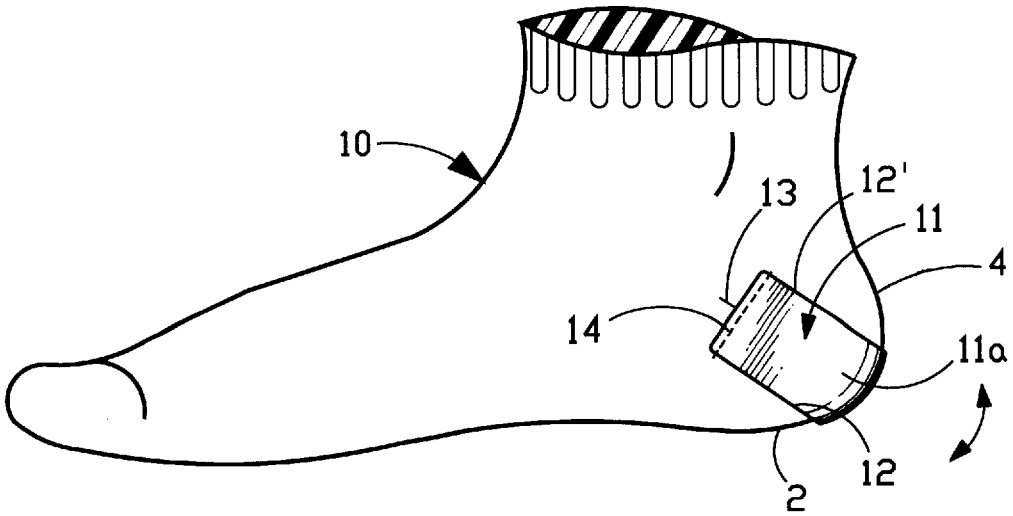
FIG. 5 is a side elevational view of another alternative location of the present invention sock with a shoehorn stitched to the sock, showing the tubular band at its initial position between the rear and bottom heel portions of the sock.

Referring to FIG. 5, there is depicted at 10 another alternative location of the stitched seams of the present invention sock with a shoehorn which is stitched to the sock, where the tubular band 11 is positioned between the bottom heel portion 2 and the rear heel portion 4 of the sock 10. In this design, the outward face 11*a* faces the outer bottom heel portion 2 while the inward face 11*b* faces the outer rear heel portion 4 of the sock 10 when rolled. Prior to wearing the sock 10, the wearer turns over the upper side 12' of the tubular band 11 to the bottom heel portion 2 of the sock 10, which draws it closure to the heel seam 13 of the sock 10.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A sock used in conjunction with a shoe having an upper rim, the sock comprising:

a. a sock having two opposite sides, an outer bottom heel portion and an outer rear heel portion; and b. an elongated elastic tubular band having an inward face, an outward face, a first end and a second end, the first end stitched to one side of said sock and adjacent to said heel portions of said sock, the second end stitched to the other side of said sock and adjacent to said heel portions of said sock such that the inward face abuts against said bottom heel portion, where the tubular band is rollable from said bottom heel portion to said rear heel portion such that the outward face is turned over and abuts against said rear heel portion;

c. whereby said elongated elastic tubular band is positioned above said upper rim of said shoe and when said sock is inserted into said shoe, said tubular band rolls from said bottom heel portion to said rear heel portion such that said elongated elastic tubular band facilities the wearing of said sock and is hidden within said shoe.

2. The sock in accordance with claim 1 wherein said sock includes stockings.

3. The sock in accordance with claim 1 wherein said sock includes panty hose.

4. The sock in accordance with claim 1 wherein said elongated elastic tubular band is made out of a long strip of cloth.

5. A sock used in conjunction with a shoe, comprising:

a. a sock having two sides, a bottom heel portion and a rear heel portion; and b. an elongated elastic band member having an inward face, an outward face, a first end and a second end, the first end stitched to one side of said sock and adjacent to said heel portions of said sock, the second end stitched to the other side of said sock and adjacent to said heel portions of said sock such that the inward face abuts against said bottom heel portion, where the band member is rollable from said bottom heel portion to said rear heel portion such that the outward face is turned over and abuts against said rear heel portion;

c. whereby said sock is inserted into said shoe, said elongated elastic band member rolls from said bottom heel portion to said rear heel portion such that said elongated elastic band member facilities the wearing of said sock and is hidden within said shoe.

6. The sock in accordance with claim 5 wherein said sock includes stockings.

7. The sock in accordance with claim 5 wherein said sock includes panty hoses.

8. The sock in accordance with claim 5 wherein said elongated elastic band member is made out of a long strip of cloth.

9. A sock, comprising:

a. a foot cover member having a heel; and b. a band member having a first end attached to one side of said heel of said foot cover member and a second end attached to the other side of said heel of said foot cover member, where the band member is rollable between one portion of said heel and another portion of said heel of said foot cover member;

c. whereby said band member rolls from said one portion of said heel to said another portion of said heel such that said band member facilities the wearing of said foot cover member.

10. The sock in accordance with claim 9 wherein said foot cover member includes stockings.

11. The sock in accordance with claim 9 wherein said foot cover member includes panty hose.

12.The sock in accordance with claim 9 wherein said foot cover member is made out of a long strip of cloth.

* * * * *